US006207021B1

(12) United States Patent
Eriksson et al.

(10) Patent No.: US 6,207,021 B1
(45) Date of Patent: Mar. 27, 2001

(54) CREPING BLADE

(75) Inventors: Tore Eriksson, Klässbol (SE); Silvano Freti, Bursinel (CH)

(73) Assignee: BTG Eclepens S.A., Eclepens (CH)

( * ) Notice: Subject to any disclaimer, the term of this patent is extended or adjusted under 35 U.S.C. 154(b) by 0 days.

(21) Appl. No.: 09/171,880

(22) PCT Filed: Apr. 22, 1997

(86) PCT No.: PCT/SE97/00678

§ 371 Date: Dec. 2, 1998

§ 102(e) Date: Dec. 2, 1998

(87) PCT Pub. No.: WO97/41299

PCT Pub. Date: Nov. 6, 1997

(30) Foreign Application Priority Data

May 2, 1996 (SE) ..... 9601679

(51) Int. Cl.[7] ..... D21G 3/04
(52) U.S. Cl. ..... 162/281; 15/256.51; 34/120
(58) Field of Search ..... 162/280, 281; 15/256.51; 34/117, 120

(56) References Cited

U.S. PATENT DOCUMENTS 3,688,336 * 9/1972 Costello, Jr. et al. ..... 15/256.51
3,703,019 * 11/1972 Bratt ..... 15/256.51
4,247,196 * 1/1981 Ogawo ..... 15/256.51

FOREIGN PATENT DOCUMENTS 978988 1/1965 (GB) .
1289609 9/1972 (GB) .
2130924 6/1984 (GB) .
WO86/07309 12/1986 (WO) .

* cited by examiner

*Primary Examiner*—Karen M. Hastings
(74) *Attorney, Agent, or Firm*—Burns, Doane, Swecker & Mathis, L.L.P.

(57) ABSTRACT

Creping blade for the detachment of a travelling paper web from a dryer cylinder, said blade having an edge or tip section engaging said cylinder and being constantly hit by the traveling web during its detachment from the cylinder. The invention resides in the improvement of said edge or tip section being provided with a wear-resistant coating on a first part of said edge section hit by the web, the other part of said edge section engaging the cylinder being uncoated or coated with a non-wear-resistant material so that said other part is subjected to sliding wear. A recess is located in the side surface so that the wear land surface that contacts the cylinder remains essentially constant throughout the operative cycle of the blade.

16 Claims, 3 Drawing Sheets

CREPING BLADE

The present invention relates to a creping blade for the detachment of a travelling paper web from a rigid dryer cylinder to form a porous paper product, so called tissue.

BACKGROUND OF THE INVENTION

Scrapers or doctor blades are extensively used in the paper industry for different purposes but in most of the cases their function is to clean or scrape off material or residues from the surface of a rotating roll. A specific application of blades is constituted by their use as creping blades for the manufacture of tissue. Such blades have for a purpose to detach a paper web from a rigid dryer cylinder, usually a cast iron cylinder, by scraping the surface of the cylinder. At the same time the top or edge surface of the blade exerts a compressive action on the paper thereby creating the typical crepe structure of a tissue product.

Since creping blades are subjected to extensive wear different techniques to increase their life time are being used, such as adding wear resistant material onto the section of the blade engaging the cylinder. As an example of such reinforcement of the top or edge surface of the blade ceramic hardfacings are currently used as a practical solution to reduce the blade wear. Such ceramic coatings are usually applied to blades made of hardened and tempered carbon steel and can be applied by thermal spraying, such as plasma spraying or plating.

Examples of techniques for the provision of such wear resistant coatings onto doctor blade or scrapers are found in UK patents 978,988, 1 289 609, and 2 130 924. All this prior art is directed to the provision of a wear-resistant coating on the part of the blade engaging the surface of a rotating cylinder.

SUMMARY OF THE INVENTION

The present invention is based on an entirely different concept relating to the creping blade design, said concept allowing the blade to be used for a longer period of time while maintaining a substantially constant tissue quality.

Accordingly, one object of the invention is to provide a new creping blade having a substantially extended lifetime yet allowing the provision of a high tissue quality.

Another object of the invention is to provide a creping blade provided with a wear resistant coating at the location of the blade hit by the travelling paper web.

Yet another object of the invention is to leave those parts of the blade engaging the moving cylinder substantially uncovered by such wear resistant coating to provide for a certain amount of wear of said uncoated part.

Still another object of the invention is to provide a creping blade designed in such a manner that inspite of the blade wear a substantially constant engagement specific pressure of the blade against the cylinder can be maintained.

For these and other objects which will be clear from the following description the invention provides for a creping blade for the detachment of a travelling paper web from a dryer cylinder, wherein said blade has an edge or tip section engaging said cylinder and also is constantly hit by the travelling web during its detachment from the cylinder. The improvement according to the present invention is constituted by the fact that said edge or tip section is provided with a wear resistant coating on a first part of said second hit by the web, whereas the other part of said section engaging the cylinder is uncoated or coated with a non-wear-resistant material so that said other part is subjected to sliding wear.

In a preferred embodiment of the invention the creping clade has a thickness of at least about 0.5 mm. The upper extreme of the thickness of the blade is not particularly critical but usually does not exceed 2 to 3 mm. A particularly practical range is from about 0.8 to about 1.2 mm.

The wear-resistant coating used to reduce the wear on the part of the blade which is hit by the travelling paper web during detachment can suitably be comprised by a ceramic material, but also other wear-resistant materials, such as metallic or composite materials, can be used. It is particularly preferred to use a ceramic material applied by thermal spraying, such as plasma spraying or by a PVD (physical vapour deposition) or CVD (chemical vapour deposition) process.

The wear-resistant coating is preferably comprised of a thermally sprayed material and is suitably selected from metal oxides, silicates, carbides, borides, nitrides and mixtures thereof.

Particularly preferred ceramic materials are selected from alumina, chromia, zirconiz, tungsten carbide, chromium carbide, zirconium carbide, tantalum carbide, titanium carbide and borides.

The wear-resistant coating applied in accordance with the present invention has preferably a thickness varying within the range of about 1 to 100 $\mu$m. However, the coating can have a thickness even exceeding that upper limit.

The material used in the creping blade according to the present invention is preferably a metal in the form of a strip of metal, polymeric material or composite material, and it is particularly preferred that such metal strip is comprised of hot or cold rolled steel. It is suitable to use hardened and tempered carbon steel as a material for the blade.

In another preferred embodiment of the invention the creping blade is comprised of a substantially flat strip having a top or edge surface, a side surface facing the cylinder, a junction section between said surfaces engaging said cylinder and a recess in said side surface extending along said junction section and forming a narrow wear land on the junction section, said land being subject to conformation to the moving cylinder surface.

In such embodiment it is preferred that said recess is designed in such a manner that the wear land surface engaging the cylinder surface remains essentially constant throughout the operative cycle of the blade.

Further, in relation to such embodiment the surface of the blade opposite to the wear land is provided with wear-resistant coating to broaden said top or edge surface of the blade. This will increase the depth of wear, yet maintaining the creping efficiency and a constant tissue quality.

The recess may be filled with a non-wear-resistant material. In the alternative said other section is uncoated.

BRIEF DESCRIPTION OF THE DRAWINGS

The present invention will now be described more in detail with reference to the appended drawing, wherein.

DETAILED DESCRIPTION

Figure 1:
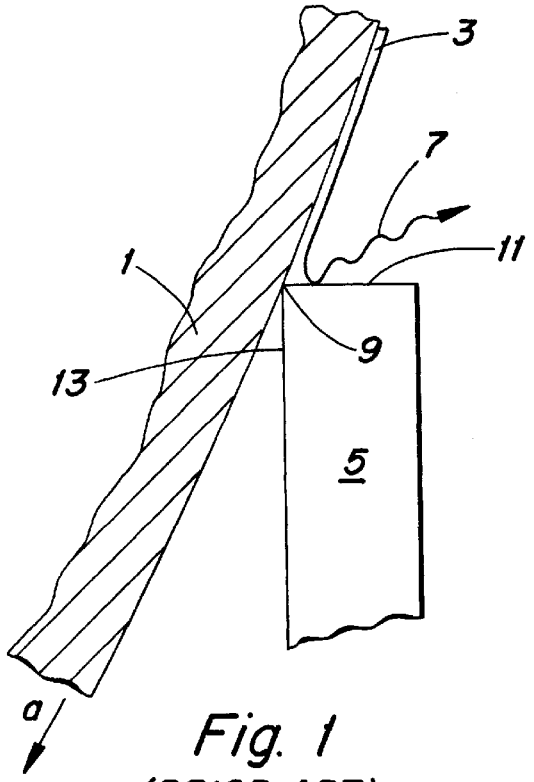
Fig. 1 (PRIOR ART)
FIG. 1 is a diagrammatical side section showing the area adjacent to the site of engagement of the blade against a moving cylinder surface.

FIG. 1 illustrates the area of engagement between the surface of a moving cylinder 1 and the edge of tip portion of a creping blade 5. Cylinder 1 moves in direction of arrow a) and transports a paper web 3 up to the edge surface 11 of the blade 5. In FIG. 1 the blade 5 engages the surface of cylinder 1 at the edge 9 joining top surface 11 and a side surface 13 facing the cylinder. When the paper web 3 hits surface 11 of the blade 5 it is detached from the cylinder and by the compressive action on the paper a typical crepe structure of a tissue product 7 will be created.

In the practice of producing tissue products two types of wear take place on the edge section of the blade 5. First, a sliding wear arises at the point of engagement of the blade 5 with the moving cylinder surface. Second, the top or edge surface 11 of the blade 5 which is constantly hit by the paper web 3 will be subjected to extensive wear or erosion as illustrated diagrammatically in FIG. 4.

Figure 2:
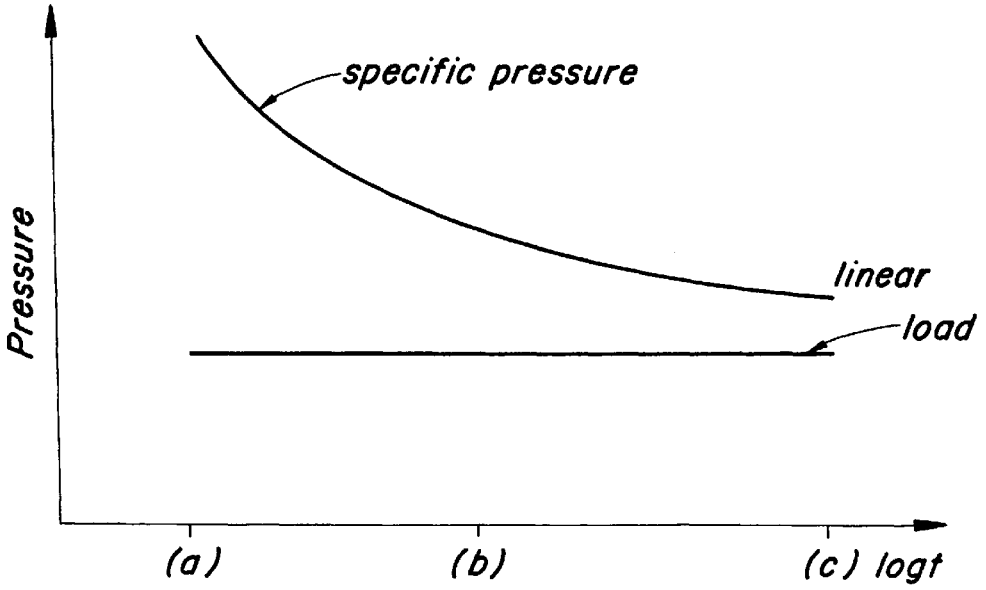
FIGS. 2, and 3A, 3B and 3C illustrate the sliding wear of the blade throughout the life of the blade.
Figure 3A:
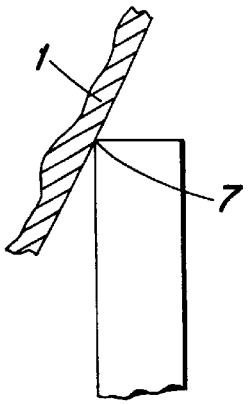
Fig. 3a (PRIOR ART)
Figure 3B:
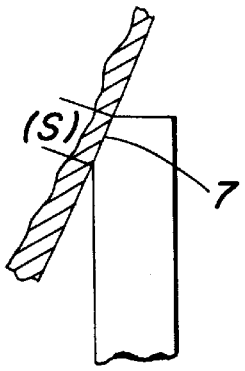
Fig. 3b (PRIOR ART)
Figure 3C:
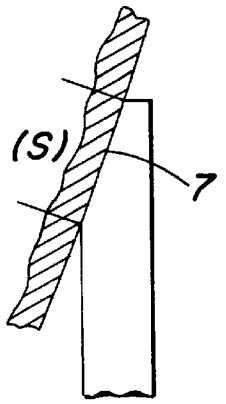
Fig. 3c (PRIOR ART)

FIGS. 2 and 3 illustrate the situation concerning the first type of water, namely the sliding wear against the moving cylinder surface. FIG. 2 illustrates in the form of a diagram the specific pressure exerted by the blade 5 onto the cylinder surface as a function of time on a logarithmic scale, and by the progression of wear as illustrated in FIG. 3 the specific pressure decreases at a constant linear load of the blade. The specific pressure applied at the beginning of the operation is thus very high but decreases with time due to the increased contact area. At point c) the specific pressure against the cylinder is insufficient to insure a proper detachment of the web making a change of blade necessary.

Figure 4:
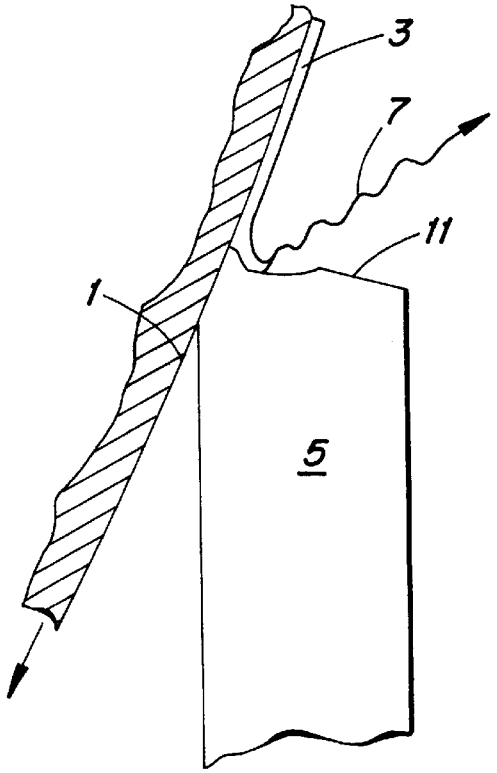
Fig. 4 (PRIOR ART)
FIG. 4 is a diagrammatic side view showing the erosion of the tip of the blade that takes place during operation.

Reverting to the second wear, namely the abrasive action of the web when hitting the edge or top surface 11 of the blade 15, the action of the paper web produces local wear of the blade as shown in FIG. 4. The geometrical configuration of the area where the blade 5 is contacted by the web 3 is of high importance for obtaining a constant crepe structure. Therefore, the abrasive action of the web when hitting the blade will cause a varying crepe characteristic unless proper measures are taken.

Figure 5:
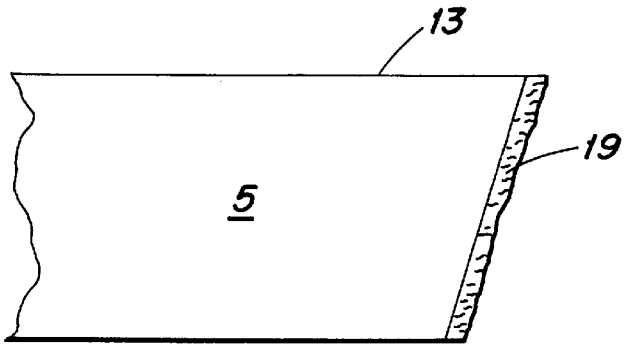
FIG. 5 shows in a side view the edge section of a blade provided with a wear-resistant coating.
Figure 6:
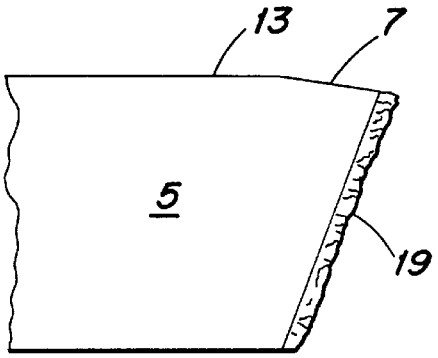
FIG. 6 shows a corresponding side view in section after some wear of the blade tip engaging the cylinder.

The solution offered by the present invention is illustrated by the embodiments shown in FIGS. 5 to 8. The solution to the problem resides in the provision of a blade design, where the surface or part of the blade engaging the cylinder is not provided with a wear-resistant coating or only provided with a non-wear-resistant coating, whereas the part of the blade edge contacted by the travelling paper web during detachment of said web is coated with a wear-resistant coating. In the embodiment of FIG. 5 such wear-resistant coating 19, for example a ceramic coating, is provided on the top or edge surface 11 of the blade 5, whereas the side surface 13 of the blade facing the cylinder remains uncoated. Therefore, during operation the outermost part of surface 13 engaging the cylinder 1 will be subjected to wear as illustrated in FIG. 6 by the wear section of land 7. In this manner by the intentional wear of the blade at the point of engagement with the cylinder 1 the point of abrasive action or erosion where the paper web 3 hits the blade, as illustrated in FIG. 4, will be moved to the right as the wear progresses, which results in a given crepe characteristic being maintained throughout the operation.

Figure 7:
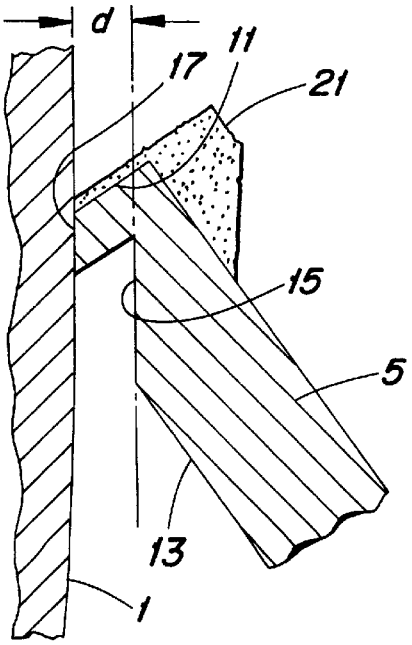
FIG. 7 shows in a diagrammatic section an embodiment of the blade with a modified wear section design.

FIG. 7 shows an alternative embodiment in regard to the design of the blade tip. In this embodiment the surface 13 facing the cylinder has been provided with a recess extending along the blade to form a narrow wear land or wear surface 17 which will in operation conform to the moving cylinder surface. In this embodiment as can be seen from FIG. 7 a constant surface 17 of engagement to the cylinder will be formed throughout the wear period all the way down to the bottom of the recess 15 resulting in maintained specific engagement pressure at a constant linear load of the blade.

To increase the surface of engagement with the travelling paper web 3 the blade is provided with a wear-resistant coating not only on the top or edge surface 11 of the blade but is also provided with wear resistant coating 21 on the side surface of the blade 5 opposite to the wear land 17 and to the inner most part of the recess 15.

Figure 8:
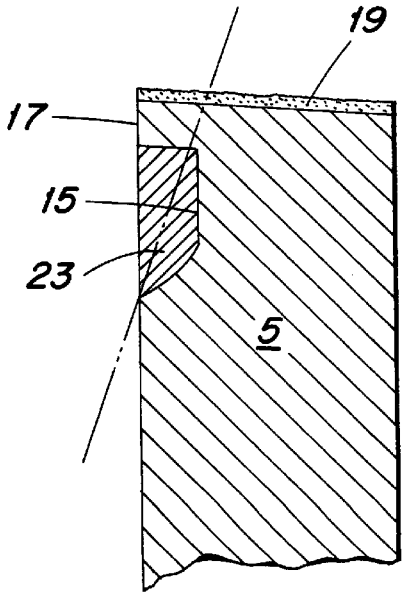
FIG. 8 shows another embodiment of a blade tip design based on the same principle.

FIG. 8 shows an embodiment operating according to the same principle as according to FIG. 7 but with a modified shape of the recess 15. Furthermore, increased blade thickness makes it possible to obtain a long life of the blade without using an exterior wear-resistant coating 21 as in the embodiment shown in FIG. 7. Further, the recess 15 may be filled with a non-wear-resistant material 23.

EXAMPLE 1

A steel blade having a thickness of 1.2 mm and without wear-resistant coating was used in a creping machine. The blade had the configuration shown in FIG. 5 but was not provided with a ceramic coating. The blade was run for about 26 h and was then analyzed from a wear standpoint. The wear land 7 had the shape as shown in FIG. 6 and a width of about 1 mm. The original 10° negative bevel of the blade edge had, however, changed by erosion creating a varying crepe structure.

EXAMPLE 2

A second trial was made using the same blade but in this case the blade was provided with a ceramic coating as shown in FIGS. 5 and 6 having a thickness of about 50 $\mu$m. After the creping operation the blade was analyzed after a period of 26 h of creping operation. The wear land 7 was of the same order of magnitude, about 1 mm, but due to the presence of the wear-resistant coating on the surface 11 engaged by the traveling paper web 3 no change in the geometry of the site of impact was observed thereby creating a constant crepe structure of the tissue product produced.

The inventive concept as illustrated by the non-limiting examples described above enables the manufacture of a tissue product of constant structure and properties throughout the operation cycle. This is made possible by the use of a blade design where sliding wear against the cylinder surface is allowed, thereby creating a moving site of contact between the edge surface 11 of the blade 5 and the travelling paper web 3. The wear-resistant layer applied to the blade shall have a thickness which does not interfere with the sliding behaviour. Furthermore, it is preferred to use a relatively thick blade, at least at the tip section thereof, such as 1 mm or more, to allow for a considerable degree of sliding wear.

It is important to note that the present invention is not restricted to the embodiments described with regard to blade configuration, blade material, type and character of wear-resistant coating, and it is obvious that various modifications of designs, materials etc. are obvious to the skilled artisan.

What is claimed is:

1. Creping blade for use with a dryer cylinder in the detachment of a traveling paper web from the dryer cylinder, said blade comprising:

en edge or tip section including a first part for contacting the travelling web and a second part for engaging the cylinder, wherein said first part of said edge or tip section is provided with a wear-resistant coating, and wherein the second part of said section is uncoated or coated with a non-wear-resistant material so that said second part is subjected to sliding wear, wherein said blade comprises a substantially flat strip having a tip or edge surface, a side surface for facing the cylinder, a junction section between said surfaces for engaging said cylinder, and a recess in said side surface extending along said junction section and forming a narrow wear land on said junction section for conforming to the moving cylinder surface, and wherein said recess is designed in such a manner that the wear land surface for engaging the cylinder surface remains essentially constant throughout the operative cycle of the blade.

2. Creping blade according to claim 1, wherein the blade has a thickness of at least about 0.5 mm.

3. Creping blade according to claim 1, wherein the wear-resistant coating is comprised of a ceramic or a metallic material or mixtures thereof.

4. Creping blade according to claim 3, wherein the wear-resistant coating is comprised of a thermally sprayed material.

5. Creping blade according to claim 3, wherein the wear-resistant coating is comprised of a material applied by physical vapor deposition or chemical vapor deposition.

6. Creping blade according to claim 3, wherein the wear resistant coating is a ceramic material selected form metal oxides, silicides, carbides, borides, nitrides, and mixtures thereof.

7. Creping blade according to claim 6, wherein the ceramic material is selected from alumina, chromia, zirconia, tungsten, carbide, chromium carbide, zirconium carbide, tantalum carbide, titanium carbide and borides.

8. Creping blade according to claim 1, wherein said first part of the edge is provided with a coated end surface which forms an angle to said second part of the edge within the range about 45° to 120°.

9. Creping blade according to claim 1, wherein the wear-resistant coating has a thickness within the range about 1 to 100 $\mu$m.

10. Creping blade according to claim 1, wherein said blade comprises a metal in the form of a strip of metal, a polymeric material, or a composite material.

11. Creping blade according to claim 10, wherein said blade comprises a metal in the form of a metal strip comprised of hot or cold rolled steel.

12. Creping blade according to claim 1, wherein said blade is formed from a first material and said recess is filled with a non-wear-resistant material, the non-wear resistant material being different from the first material.

13. Creping blade according to claim 1, wherein said second part of said section is uncoated.

14. Creping blade according to claim 4, wherein the wear-resistant material is a ceramic material selected from metal oxides, silicides, carbides, borides, nitrides and mixtures thereof.

15. Creping blade according to claim 1, wherein the side surface of the blade opposite to the wear land is provided with wear-resistant coating to broaden said top or edge surface, thereby increasing the depth of wear with maintained creping efficiency.

16. Creping blade according to claim 1, wherein said first part defines a top surface of said blade and said second part defines a side surface of said blade.

* * * * *